US009649570B2

(12) United States Patent
Karsten et al.

(10) Patent No.: US 9,649,570 B2
(45) Date of Patent: May 16, 2017

(54) TOY WITH CONVERTIBLE NECKLACE

(71) Applicants: Lisa McCue Karsten, Annapolis, MD (US); Kenneth Stephen Karsten, Jr., Annapolis, MD (US)

(72) Inventors: Lisa McCue Karsten, Annapolis, MD (US); Kenneth Stephen Karsten, Jr., Annapolis, MD (US)

( * ) Notice: Subject to any disclaimer, the term of this patent is extended or adjusted under 35 U.S.C. 154(b) by 0 days.

(21) Appl. No.: 15/043,932

(22) Filed: Feb. 15, 2016

(65) Prior Publication Data

US 2016/0236106 A1 Aug. 18, 2016

Related U.S. Application Data

(60) Provisional application No. 62/116,317, filed on Feb. 13, 2015, provisional application No. 62/116,316, filed on Feb. 13, 2015.

(51) Int. Cl.

| | |
|---|---|
| ***A63H 3/00*** | (2006.01) |
| ***A63H 3/14*** | (2006.01) |
| ***A63H 3/02*** | (2006.01) |
| ***A63H 3/16*** | (2006.01) |

(52) U.S. Cl.

CPC ..... *A63H 3/14* (2013.01); *A63H 3/005* (2013.01); *A63H 3/02* (2013.01); *A63H 3/16* (2013.01)

(58) Field of Classification Search

CPC . A63H 3/02; A63H 3/14; A63H 33/00; A63H 33/003; A63H 33/005; A45C 3/06; A45C 13/26; A45F 3/02; A45F 5/004

See application file for complete search history.

(56) References Cited

U.S. PATENT DOCUMENTS

| | | | | | |
|---|---|---|---|---|---|
| 1,468,711 | A * | 9/1923 | Dwyer | A45C 13/26 | 150/108 |
| D129,750 | S * | 9/1941 | Blake | 150/108 | |
| 2,347,405 | A * | 4/1944 | Ford | A63H 3/02 | 446/369 |
| 2,454,013 | A * | 11/1948 | Scherzinger | B65D 33/12 | 383/16 |
| 2,788,040 | A * | 4/1957 | Hullweck | A45C 13/18 | 150/110 |
| 3,087,277 | A * | 4/1963 | McCook | A63H 33/006 | 224/584 |
| 3,746,066 | A * | 7/1973 | McIntyre | A45C 7/0063 | 150/107 |
| 3,930,331 | A * | 1/1976 | Simeone | A63H 33/00 | 434/260 |
| 4,037,633 | A * | 7/1977 | Gordon | A45C 13/26 | 150/110 |

(Continued)

*Primary Examiner* — Aarti B Berdichevsky
*Assistant Examiner* — Urszula M Cegielnik
(74) *Attorney, Agent, or Firm* — 24IP Law Group; Timothy R DeWitt

(57) ABSTRACT

In a preferred embodiment, the present invention is a plush toy having a body, a first pocket, a second pocket, and an extendable member that may be positioned as a necklace, a headband or a strap. The extendable member may be retracted into one of the pockets through a hole or holes in the body of the toy leaving only a small portion of the extendable member external to the body or may be extended from the body. When retracted, the extendable member may be positioned, for example, as a necklace or a headband.

10 Claims, 7 Drawing Sheets

(56) References Cited

U.S. PATENT DOCUMENTS 4,202,135 A * 5/1980 Siler ..... A63H 3/14 446/327
4,268,037 A * 5/1981 McKinley ..... A63B 69/0068 273/359
4,304,065 A * 12/1981 Baiera ..... A63H 3/14 446/327
4,504,240 A * 3/1985 Thomas ..... A63H 3/14 446/100
4,581,904 A * 4/1986 Lehmann ..... A63H 3/16 446/310
4,643,694 A * 2/1987 Phibbs ..... A63H 3/14 446/327
4,763,763 A * 8/1988 Sadow ..... A45C 13/26 150/108
4,776,049 A * 10/1988 Perron ..... A47C 7/383 297/393
4,838,827 A * 6/1989 Schlaifer ..... A63H 3/14 446/327
D313,311 S * 1/1991 Senitt ..... D21/600
5,027,874 A * 7/1991 Gazzola ..... A45F 3/02 150/107
5,046,980 A * 9/1991 Tai ..... A63H 3/003 2/49.4
5,083,966 A * 1/1992 Blank ..... A63H 3/02 446/369
5,201,443 A * 4/1993 Oswald ..... A47G 25/32 223/85
D344,312 S * 2/1994 Lamb ..... D21/628
5,283,969 A * 2/1994 Weiss ..... G09F 3/005 40/633
5,374,192 A * 12/1994 Marble ..... G09B 19/00 210/505
5,398,344 A * 3/1995 Hirano ..... A41B 11/00 2/158
5,415,332 A * 5/1995 Kliot ..... A45F 3/02 150/106
5,431,317 A * 7/1995 Kliot ..... A45F 3/02 224/153
5,540,609 A * 7/1996 Hoag ..... A63H 3/00 446/26
5,626,503 A * 5/1997 Heftel ..... A63H 3/003 132/275
5,733,166 A * 3/1998 Hoag ..... A63H 3/00 40/735
5,950,888 A * 9/1999 Nolan-Brown ..... A42B 1/004 2/209.13
5,975,980 A * 11/1999 Whiteneck ..... A63H 3/24 446/304
6,030,274 A * 2/2000 Kaplan ..... A63H 3/003 206/457
6,053,381 A * 4/2000 Fahl ..... A45F 3/047 150/108
6,126,507 A * 10/2000 Lieberman ..... A42B 1/004 2/209.11
6,276,074 B1 * 8/2001 Martin ..... A43B 3/0078 36/1
6,350,169 B1 * 2/2002 Holt ..... A63H 3/14 446/327
6,622,899 B1 * 9/2003 Klindworth-Garron .. A45F 3/02 224/578
6,966,472 B2 * 11/2005 Szarek ..... A44C 15/005 224/250
7,351,128 B1 * 4/2008 Burns ..... A47G 7/08 248/175
7,410,403 B1 * 8/2008 Altschul ..... A63H 3/02 446/26
7,708,141 B1 * 5/2010 Huang ..... A45C 3/02 206/425
8,827,760 B2 * 9/2014 Ushibo ..... A63H 3/003 446/268
2002/0108688 A1 * 8/2002 Reiss ..... A44C 5/00 150/110
2003/0186614 A1 * 10/2003 Taylor ..... A45F 5/00 446/26
2003/0211808 A1 * 11/2003 Yarbrough ..... A01K 15/025 446/327
2004/0102133 A1 * 5/2004 Yarbrough ..... A01K 15/025 446/327
2007/0232186 A1 * 10/2007 Shamah ..... A63H 3/005 446/369
2009/0068922 A1 * 3/2009 Brielmann ..... A63H 3/36 446/268

* cited by examiner

TOY WITH CONVERTIBLE NECKLACE

CROSS-REFERENCE TO RELATED APPLICATIONS

The present application claims the benefit of the filing date of U.S. Provisional Patent Application Ser. No. 62/116,317 and No. 62/116,316, both filed by the present inventors on Feb. 13, 2015.

The aforementioned provisional patent applications are hereby incorporated by reference in their entirety.

STATEMENT REGARDING FEDERALLY SPONSORED RESEARCH OR DEVELOPMENT

None.

BACKGROUND OF THE INVENTION

Field of the Invention

The present invention relates to relates to toys, and more particularly, to plush toys having multiple configurations.

Brief Description of the Related Art

A wide variety of plush toys, puppets and toy purses are known in the toy industry. Example includes the toys disclosed by the present inventors in U.S. Pat. No. 8,721,385 and U.S. Patent Application Publication No. 2014/0349549, which are hereby incorporated by reference.

SUMMARY OF THE INVENTION

In a preferred embodiment, the present invention is a plush toy having a body, a first pocket, a second pocket, and an extendable member that may be positioned as a necklace, a headband or a strap. The extendable member may be retracted into one of the pockets through a hole or holes in the body of the toy leaving only a small portion of the extendable member external to the body or may be extended from the body. When retracted, the extendable member may be positioned, for example, as a necklace or a headband.

In another preferred embodiment the present invention is a toy having a body, with a first pocket within the body, the pocket having an opening to provide a user access to the pocket from the exterior of the body, a second pocket, the second pocket having an opening through which a user's hand may be inserted in the manner of a puppet, and an elongated strap, the elongated strap having first and second ends, wherein the first end is slidably secured within one of the first and second pockets to provide for the elongated strap to be partially withdrawn into the first or second pocket or extended from the first or second pocket. In a first configuration the elongated strap is extended from the body and in a second configuration the elongated strap is withdrawn into the first pocket such that the elongated straps forms one of a necklace and a headband for the body. The second end of the elongated strap may slidably secured within one of the first and second pockets to provide for the elongated strap to be partially withdrawn into the first or second pocket or extended from the first or second pocket. Alternatively, the second end may be fixed to the body. Further, the second end may be fixed to the body within one of the first and second pockets. The toy further may have a zipper on the body around the opening of one or both of the pockets to close and open those pockets. A plurality of accessory members clipped onto the elongated strap or onto the body or within the first or second pockets.

Further, the first end of said extendable strap is within the first pocket and the first pocket has a hole through which the extendable strap passes, wherein the extendable strap may be withdrawn through the hole into the first pocket by pulling said first end.

Still other aspects, features, and advantages of the present invention are readily apparent from the following detailed description, simply by illustrating a preferable embodiments and implementations. The present invention is also capable of other and different embodiments and its several details can be modified in various obvious respects, all without departing from the spirit and scope of the present invention. Accordingly, the drawings and descriptions are to be regarded as illustrative in nature, and not as restrictive. Additional objects and advantages of the invention will be set forth in part in the description which follows and in part will be obvious from the description, or may be learned by practice of the invention.

BRIEF DESCRIPTION OF THE DRAWINGS

For a more complete understanding of the present invention and the advantages thereof, reference is now made to the following description and the accompanying drawings, in which.

DETAILED DESCRIPTION OF THE PREFERRED EMBODIMENTS

Figure 1A:
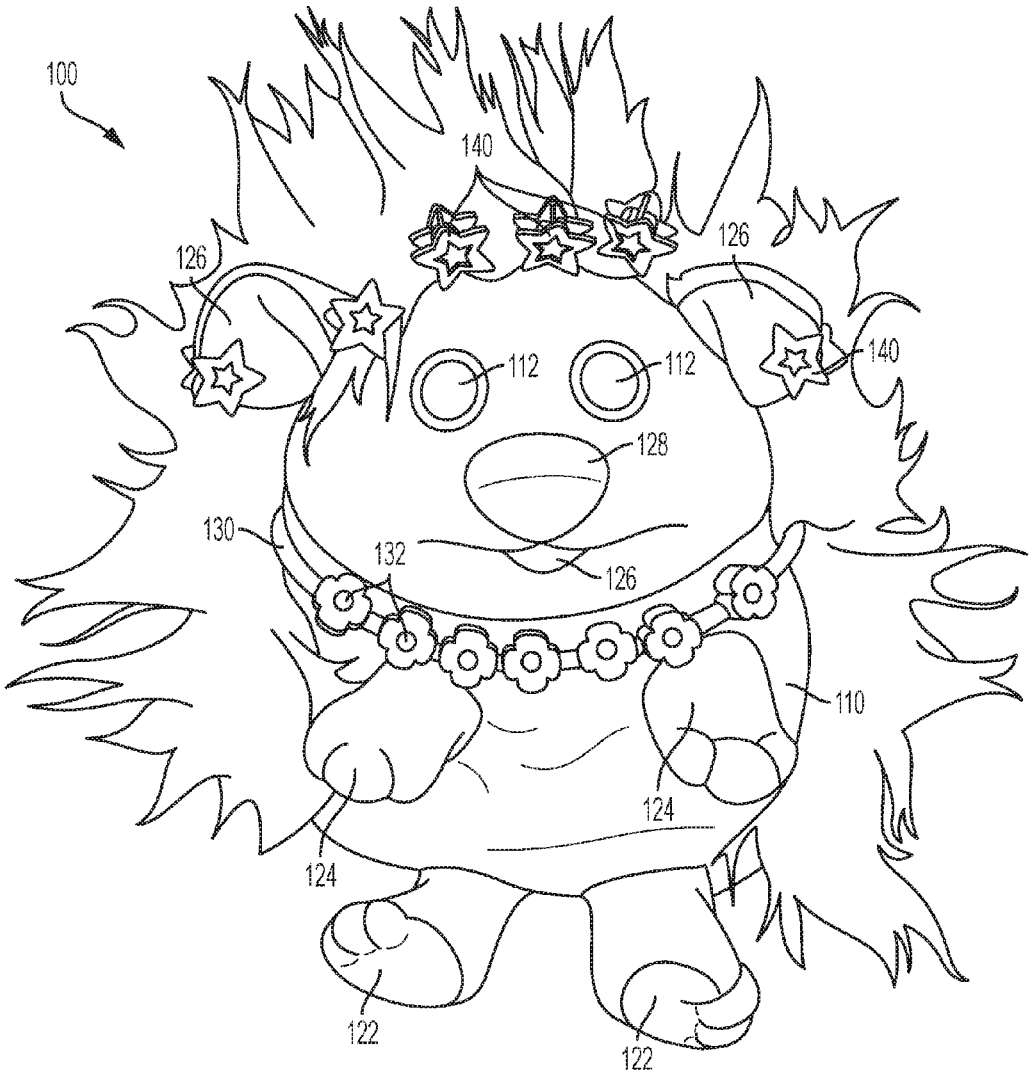
FIG. 1A is front view of a preferred embodiment of the present invention with the extendable member positioned as a necklace.
Figure 1B:
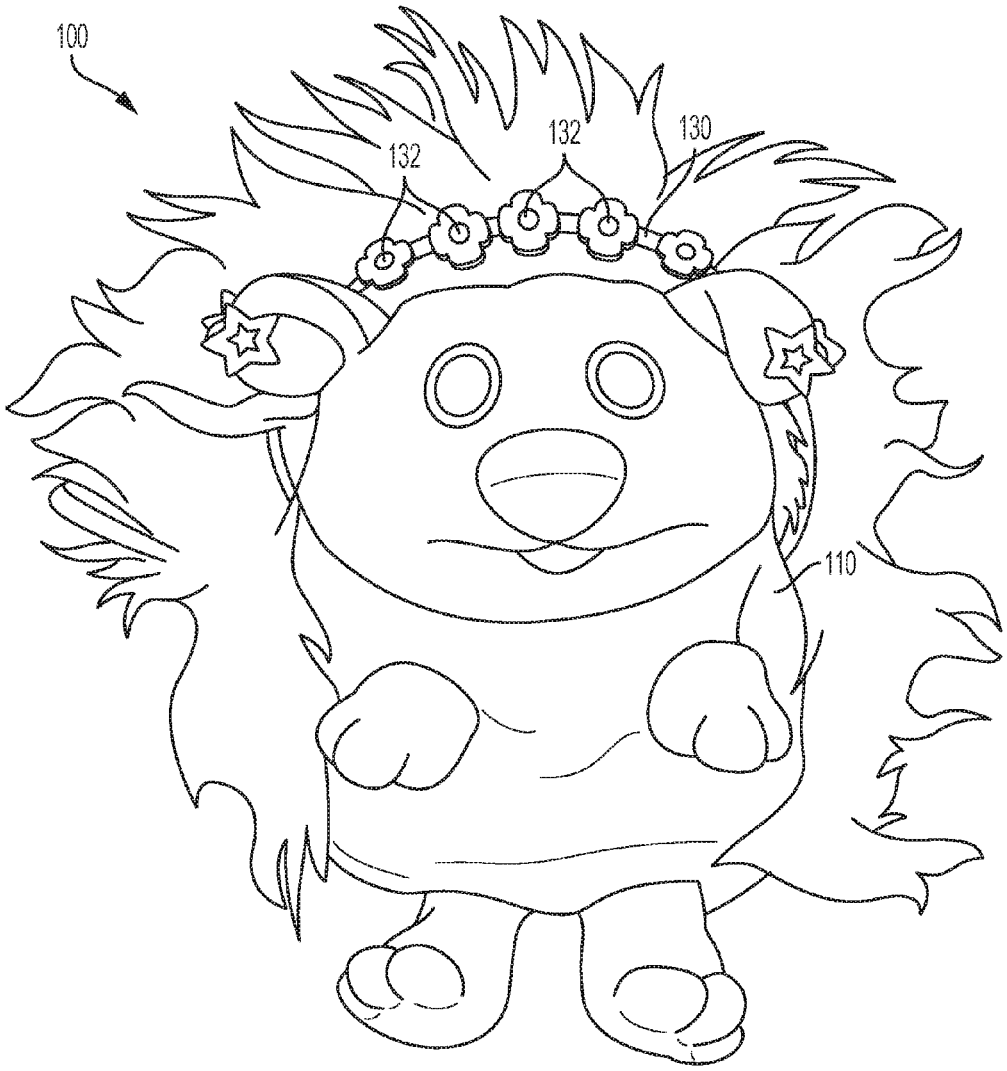
FIG. 1B is an image of a preferred embodiment of the present invention with the extendable member positioned as a headband.
Figure 1C:
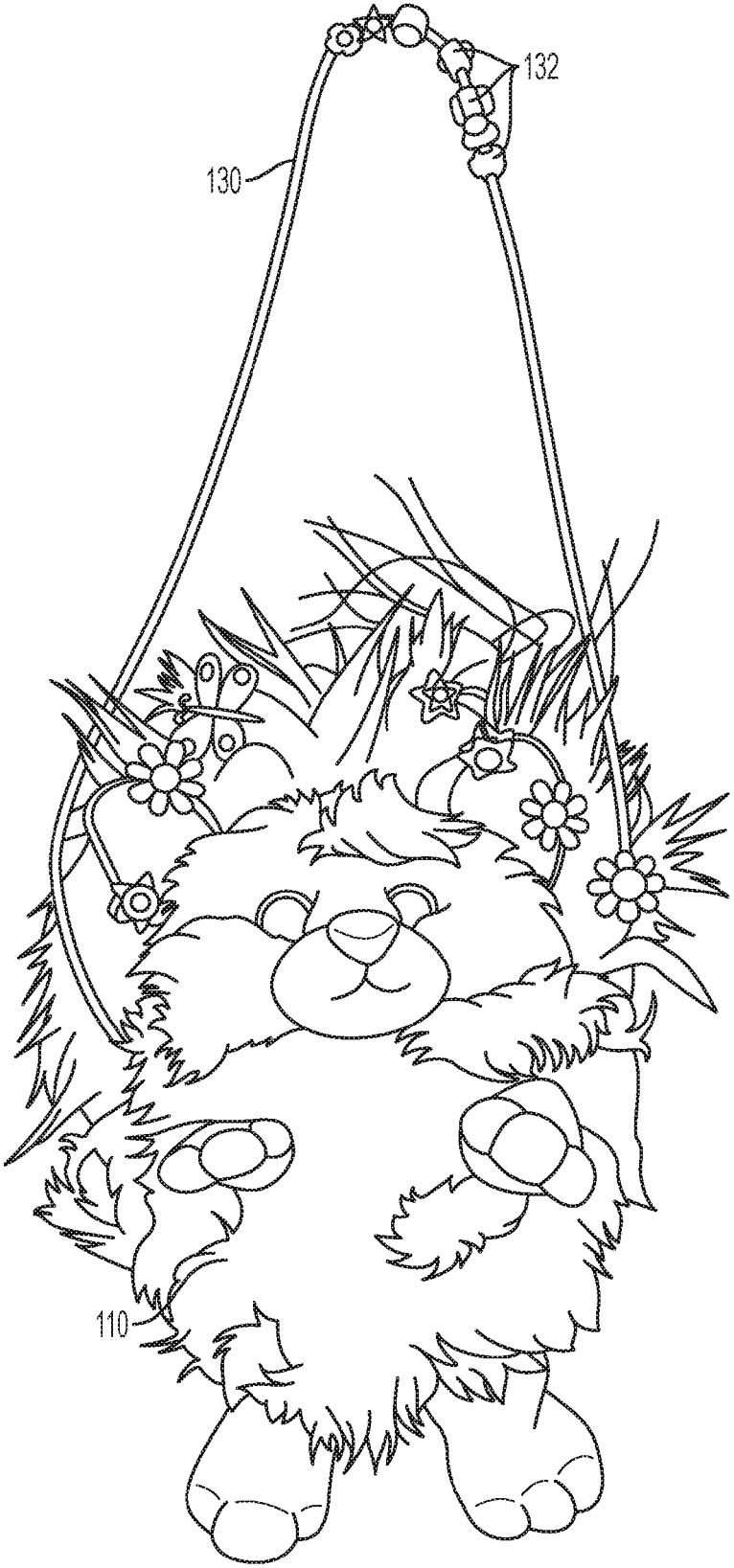
FIG. 1C is an image of a preferred embodiment of the present invention with the extendable member fully extended to form a strap, for example, for a purse.

Preferred embodiments of the invention are described with reference to the drawings. As shown in FIG. 1A, a toy 100 in accordance with a preferred embodiment of the present invention has a body 110 having eyes 112, legs 122, arms 124, mouth 126 and nose 128 all fixed to the body 110. The legs 122, arms 124, mouth 126 and nose 128 are fixed by known means, such as being sewn with thread. Other fixed features such as a tongue or tail may be included. A variety of removable features 140 such hair clips, jewelry and others may be removably attached to the body 110, legs 122, arms 124, mouth 126 or nose 128. In alternate embodiments, the legs 122, arms 124, mouth 126 and nose 128 may be removably attached rather than being fixed to the body. The toy 100 has an elongated strap 130 than may be placed in a variety of different positions include a necklace as shown in FIG. 1A and head band as shown in FIG. 1B. The ends of the elongated strap 130 extend through a hole or holes in the rear of the body 110 to a first interior pocket or chamber 150 within the body 110. The ends of the strap 130 are secured within the pocket 114 in some manner, such as with a knot or a retention member fixed to each end. With the elongates strap extended outside the body 110 as shown in FIG. 1D, the toy may be worn like a purse or bag as shown in FIG. 1C.

Figure 1D:
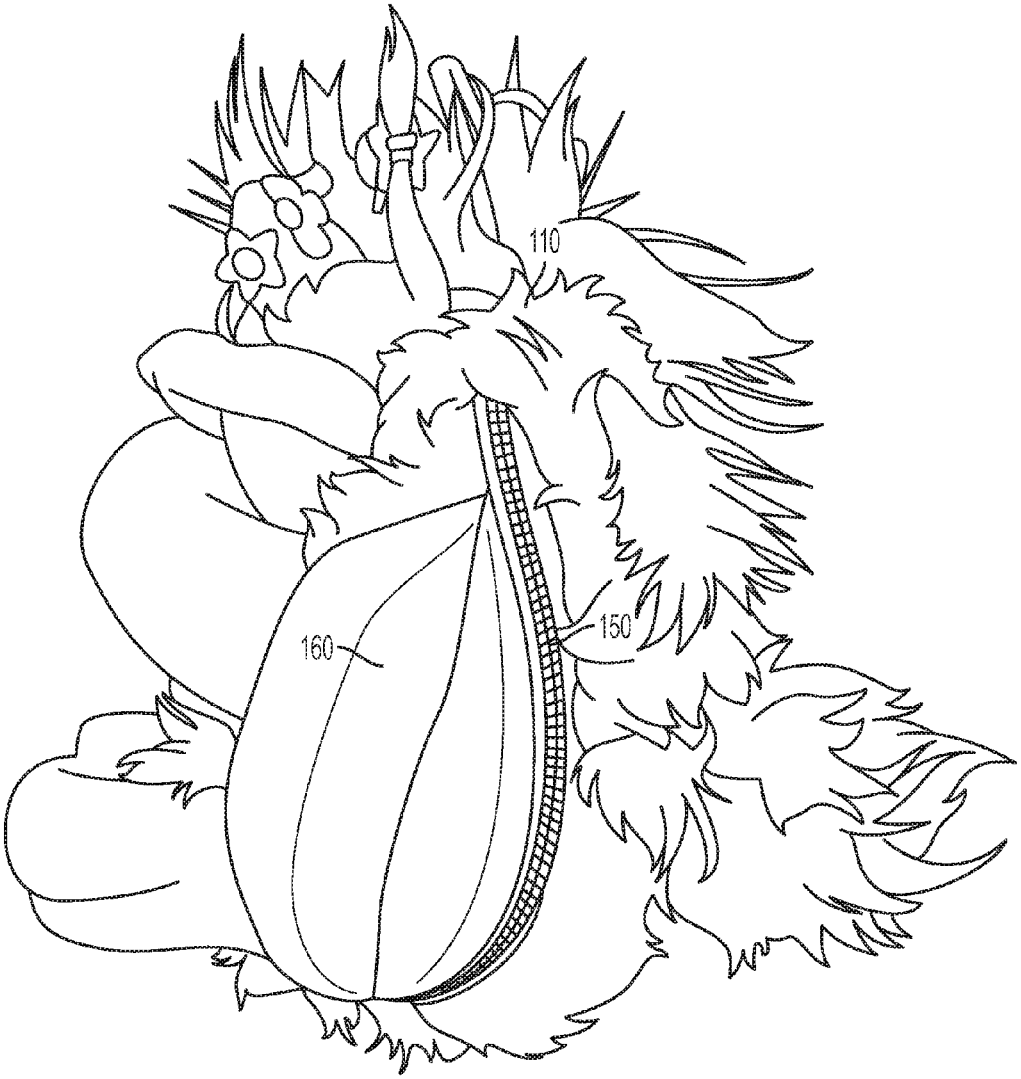
FIG. 1D is a bottom view of a preferred embodiment having a first pocket closed with a zipper and a second pocket in an open position.
Figure 1E:
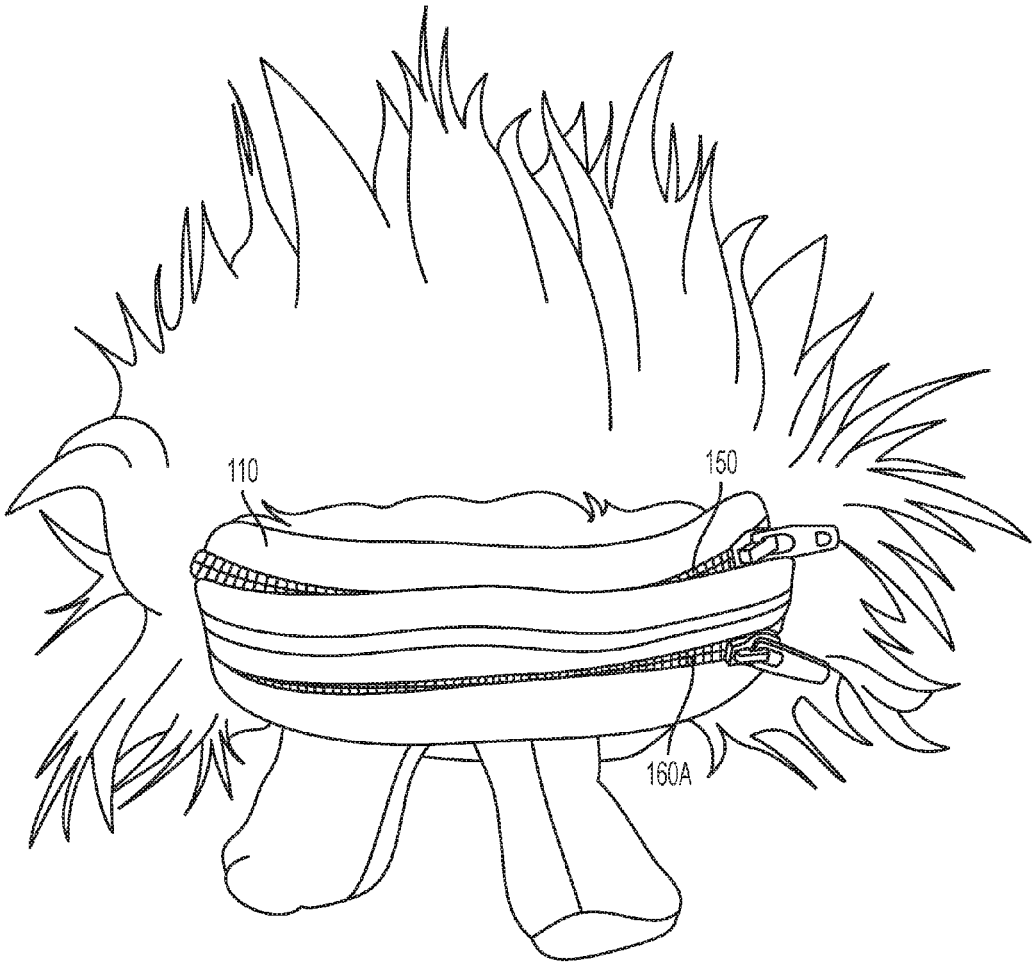
FIG. 1E is a bottom view of another preferred embodiment having first and second pockets both closed zippers.
Figure 2:
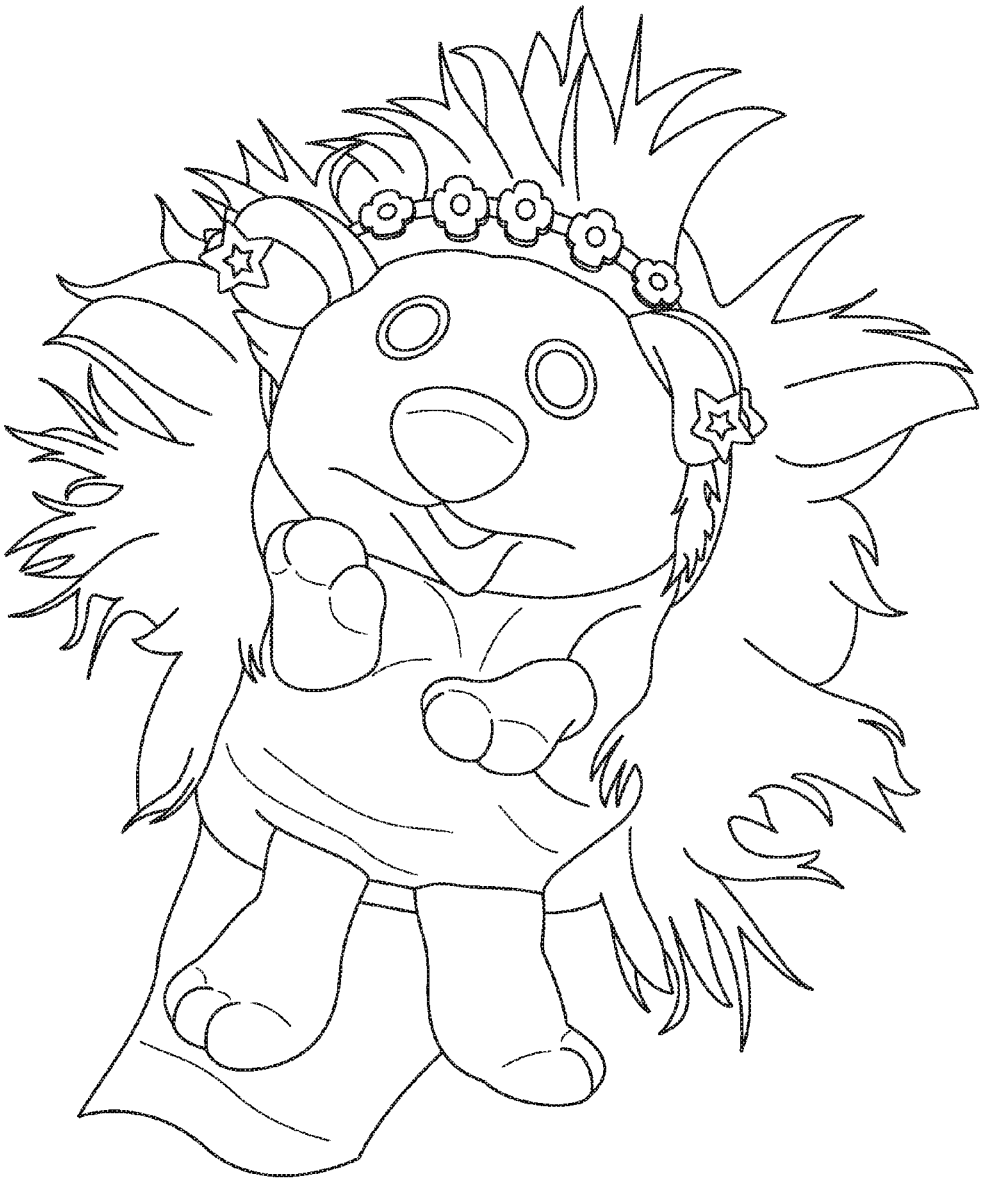
FIG. 2 is a front view of a preferred embodiment of the present invention with a user's hand inserted into one of the first and second pockets in the bottom of the body to transform the toy into a puppet.
Figure 3:
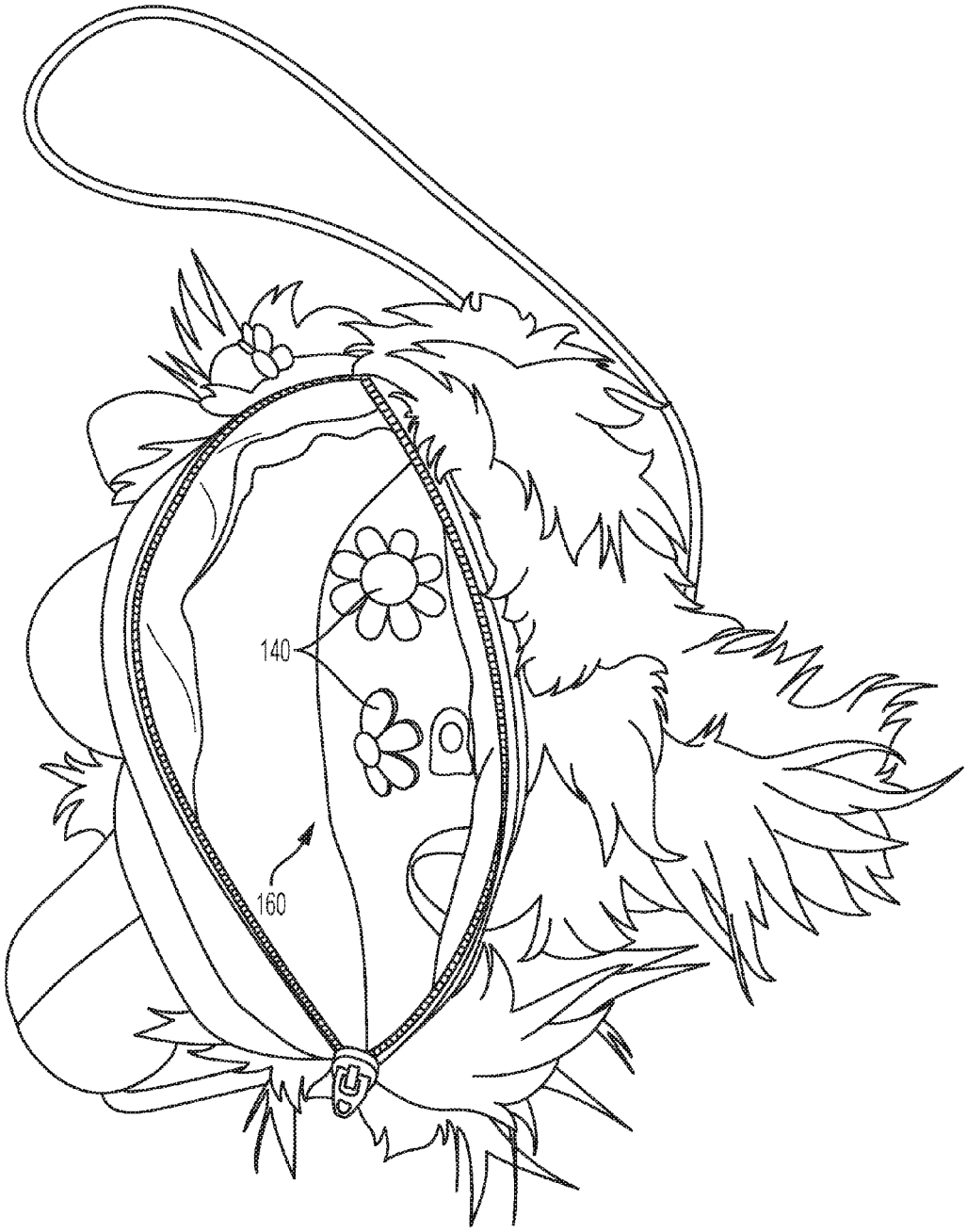
FIG. 3 is a bottom view of a preferred embodiment of the present invention with the pocket in the bottom of the body unzipped and open to reveal the removable featured stored within the pocket.

As shown in FIG. 1D, the body 150 has a first pocket 150 with a zipper. The pocket can be opened to pull the straps 130 into the pocket or to place other items inside the pocket. The body 110 has a second pocket 160 into which a user's hand may be inserted to convert the toy into a puppet as shown in FIG. 2. In an alternate embodiment as shown in FIG. 1E, a zipper may be included to close the second pocket 160. While a zipper is shown in the preferred embodiments to close one or both pockets, it shall be understood by those of skill in the other that other closure means such as Velcro, snaps, buttons or any other known means may be used to close the pockets.

The provision of the structure described creates a toy having a strap that may be positioned as a necklace, headband or other type of accessory for the toy by being placed in the desired position and withdrawing the excess portion of the strap into the pocket to hold the strap in the desired position. The strap also can be extended to a position long enough to serve, for example, as a shoulder strap for the toy. Still further, a mechanism may be placed on the strap on the interior of the pocket to hold the strap at the desired length for whichever position to the places the strap to.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A toy comprising:

a body, said body having an eye and at least one of an arm and a leg;

a first pocket within said body, said pocket having an opening to provide a user access to said pocket from the exterior of said body;

a second pocket, said second pocket having an opening through which a user's hand may be inserted in the manner of a puppet; and an elongated strap, said elongated strap having first and second ends, wherein said first end is slidably secured within one of said first and second pockets to provide for said elongated strap to be partially withdrawn into said first or second pocket or extended from said first or second pocket and said second end is secured to said body or within one of said first and second pockets;

wherein in a first configuration said elongated strap is extended from said body and in a second configuration said elongated strap is withdrawn into said first pocket such that the elongated strap forms one of a necklace between said eye and said at least one of an arm and a leg and a headband above said eye.

2. A toy according to claim 1, wherein said second end is slidably secured within one of said first and second pockets to provide for said elongated strap to be partially withdrawn into said first or second pocket or extended from said first or second pocket.

3. A toy according to claim 1, further comprising a zipper on said body for closing one of said first and second pockets.

4. A toy according to claim 1, further comprising a zipper on said body for closing said first pocket and a zipper on said body for closing said second pocket.

5. A toy according to claim 1 further comprising a plurality of accessory members clipped onto said elongated strap.

6. A toy according to claim 1 further comprising a plurality of accessories within said first pocket.

7. A toy according to claim 1, wherein said first end of said elongated strap is within said first pocket and said first pocket has a hole through which said elongated strap passes, wherein said elongated strap may be withdrawn through said hole into said first pocket by pulling said first end.

8. A toy comprising:

a body having a face and at least one of a pair of arms and a pair of legs;

a first pocket within said body, said pocket having an opening to provide a user access to said pocket from the exterior of said body;

a second pocket, said second pocket having an opening through which a user's hand may be inserted, wherein said at least one of a pair of arms and a pair of legs is configure so that when a user's hand is inserted into said second pockets a user's finger may be inserted into said at least one of a pair of arms and a pair of legs to control said at least one of a pair of arms and a pair of legs in the manner of a puppet; and an elongated strap, said elongated strap having first and second ends, wherein said first end is slidably secured within one of said first and second pockets to provide for said elongated strap to be partially withdrawn into said first or second pocket or extended from said first or second pocket and said second end is secured to said body or within one of said first and second pockets;

wherein in a first configuration said elongated strap is extended from said body and in a second configuration said elongated strap is withdrawn into said first pocket such that the elongated strap forms one of a necklace between said face and said at least one of an arm and a leg and a headband above said face.

9. A toy according to claim 1 wherein said first end is slidably secured within one of said first and second pockets with a knot.

10. A toy according to claim 1 wherein said first end is slidably secured within one of said first and second pockets with a fastener.

* * * * *